US006016723A

United States Patent [19]

Hillinger

[11] Patent Number: 6,016,723

[45] **Date of Patent: *Jan. 25, 2000**

[54] RATCHETING ADJUSTABLE WRENCH

[75] Inventor: George Hillinger, Los Angeles, Calif.

[73] Assignee: Alltrade Inc., Long Beach, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/250,452

[22] Filed: Feb. 16, 1999

[51] Int. Cl.[7] ..... B25B 13/46; B25B 13/16

[52] U.S. Cl. ..... 81/63.1; 81/166; 81/175; 81/58

[58] Field of Search ..... 81/58–63.2, 155–176

[56] References Cited

U.S. PATENT DOCUMENTS

| | | | |
|---|---|---|---|
| 716,197 | 12/1902 | Daver | 81/58.4 |
| 1,163,229 | 12/1915 | Franke | 81/63.1 |
| 1,373,180 | 3/1921 | Durgan et al. | 81/58.2 |
| 1,382,851 | 6/1921 | Pitsch | 81/58.5 |
| 4,112,792 | 9/1978 | Guimarin | 81/63 |

*Primary Examiner*—D.S. Meislin

*Attorney, Agent, or Firm*—Robert R. Thornton

[57] ABSTRACT

A ratcheting adjustable wrench having an elongated handle and having jaw means, including a fixed first jaw element and a movable second jaw element, attached to one end of the handle, with means for selectively manually initiating longitudinal relative movement between the first jaw element and the second jaw element comprising a threaded drive member axially aligned with the second jaw element and disposed between the second jaw element and the handle, and a complementarily threaded driven member fixed to said second jaw element and extending through the drive member, a bias spring disposed between the drive member and the handle first end and operable to normally urge the drive member and so the second jaw element toward the first jaw element, and ratcheting means operable in response to torque applied to the handle in a selected first direction to longitudinally fix the first and second jaw elements with respect to a fastener clamped therebetween, whereby said first direction torque is applied to the fastener, and operable in response to torque applied to the handle in a direction opposite the first direction to release the clamping of the fastener by permitting the drive member and so the second jaw element to move away from the first jaw element so as to permit rotary relative movement between the fastener and the jaw elements.

20 Claims, 7 Drawing Sheets

RATCHETING ADJUSTABLE WRENCH

BACKGROUND OF THE INVENTION

The present invention relates to a ratchetable adjustable wrench which is adapted to engage a variety of non-circular fasteners, and in particular hex nuts and hex bolt heads, and which has a fastener engaging head which is selectably ratchetable.

Non-ratcheting adjustable wrenches of the general type with which the present invention is concerned are well known. Examples of such adjustable wrenches are shown, for example, in U.S. Pat. No. 2,912,891, issued Nov. 17, 1959, to T. Neff, U.S. Pat. No. 3,204,497, issued Sep. 7, 1965, to L. R. Dinkler, U.S. Pat. No. 4,520,699, issued Jun. 4, 1985, to M. Jeremic, U.S. Pat. No. 4,967,613, issued Nov. 6, 1990 to R. E. Cone, and U.S. Pat. No. 5,415,064, issued May 16, 1995 to C-H. Chang.

The standard arrangement for such adjustable wrenches is to have two jaws, one fixed with respect to the wrench handle and the other movable with respect to the fixed jaw. Typically, as is illustrated in the aforesaid patents, the movable jaw has an actuator element onto which an external male thread is formed, the movable jaw being attached to the actuator element by any one of a variety of means. The handle includes a knurled knob which has a complementary female threaded aperture extending therethrough, through which the male threaded actuator element extends so as to engage the female threads. Manual rotation of the knob, as by a user's thumb, causes the rotary motion of the knob to be translated into linear motion of the movable jaw, so as to selectively either clamp the jaws on to the element to which torque is to be applied or to loosen the jaws therefrom.

These prior art adjustable wrenches all suffer from a lessened degree of utility, because when they are engaged to apply torque to a fastener, either to tighten it or to release it, the adjustable wrench must be periodically removed from and reapplied to the fastener as rotation of the wrench moves the wrench against a physical stop caused by nearby structure.

Non-adjustable ratcheting wrenches are well known in the prior art. They fall generally into two classes, box end wrenches with an external ratcheting mechanism for the box, such as is shown in U.S. Pat. No. 4,748,875, issued Jun. 7, 1988 to John W. Lang, for example, and open end wrenches utilizing unique fastener gripping surfaces, such as is shown in U.S. Pat. No. 4,889,020, issued Dec. 26, 1989 to David R. Baker, for example. However such prior art non-adjustable ratcheting wrenches suffer from a common lessened degree of utility in that a given wrench may only be utilized with a single size of fastener, necessitating the availability of a multiplicity of wrench sizes to insure availability of the ratcheting function.

Consequently, a need exists for an ratcheting adjustable wrench which will be strong, easy to use, can be used in close quarters, and can fully grip the object to which torque is to be applied while avoiding the design deficiencies inherent in the prior art structures of adjustable wrenches and ratcheting wrenches referred to above.

BRIEF SUMMARY OF THE INVENTION

According to the present invention, a ratcheting adjustable wrench has an elongated handle, to one end of which is connected jaw means having a fixed member and a movable member, the jaw means fixed member having a generally hollow central portion, a first end to which the handle is joined, and a second end terminating in a first jaw element, the jaw means movable member being disposed in the hollow central portion and having a second jaw element formed at a first end thereof so as to face the first jaw element, the first and second jaw elements opening onto each other, with means for limiting the movement of the second jaw element within the hollow central portion to linear longitudinal motion toward and away from the first jaw element and means for selectively manually initiating longitudinal relative movement between the first jaw element and the second jaw element comprising a threaded drive member axially aligned with the second jaw element and disposed between the second jaw element and the handle, means for fixing the drive member within the hollow central portion so that the drive member is laterally fixed in position and rotatable therewithin in axial alignment with the second jaw element, including a complementarily threaded driven member fixed to said second jaw element and extending through the drive member, and a bias spring disposed in said hollow central portion between the drive member and the handle first end and operable to normally urge the drive member and so the second jaw element toward the first jaw element, whereby selective manual rotation of the drive member in a first direction is operable to move the second jaw element in a first linear direction toward the first jaw element to clamp a fastener therebetween, and selective manual rotation of the drive member in the opposite direction moves the second jaw element in the opposite linear direction to release the clamping of the fastener, and ratcheting means operable in response to torque applied to the handle in a selected first direction to longitudinally fix the first and second jaw elements with respect to a fastener clamped therebetween, whereby said first direction torque is applied to the fastener, and operable in response to torque applied to the handle in a direction opposite the first direction to release the clamping of the fastener by permitting the drive member and so the second jaw element to move away from the first jaw element so as to permit rotary relative movement between the fastener and the jaw elements.

BRIEF DESCRIPTION OF THE SEVERAL VIEWS OF THE DRAWING

The invention may be more readily understood by reference to the accompanying drawing, in which.

DETAILED DESCRIPTION OF THE INVENTION

Figure 1:
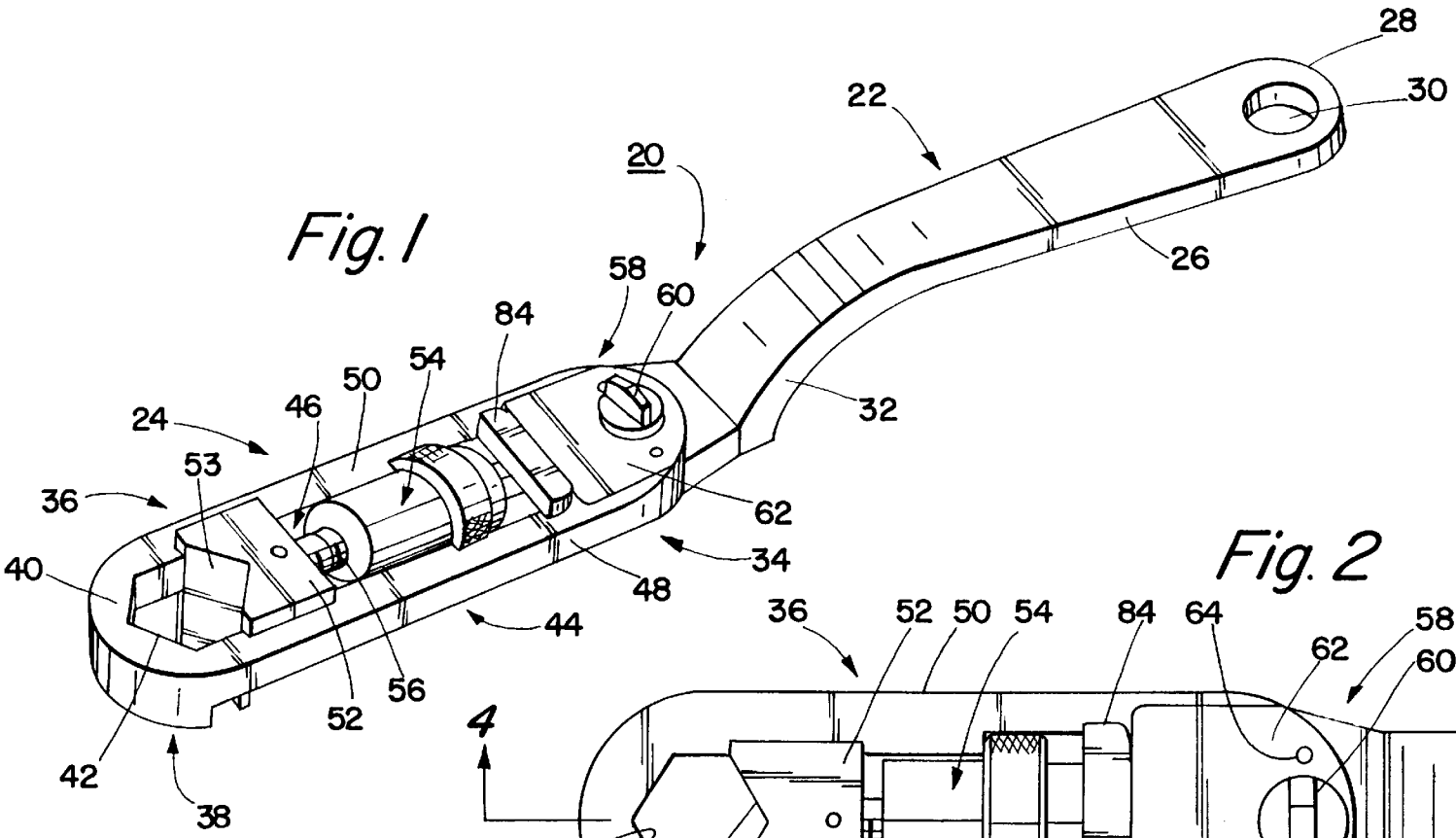
FIG. 1 is a view, in perspective, of a ratcheting adjustable wrench according to the present invention.
Figure 2:
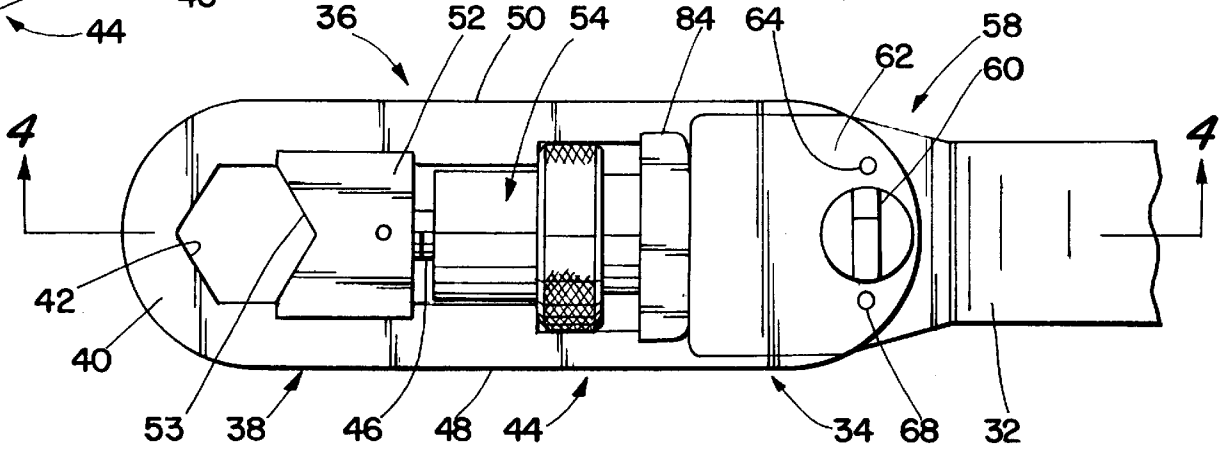
FIG. 2 is a top plan view of a portion of the wrench of FIG. 1.

Referring now to FIGS. 1 and 2, there is shown in perspective a ratcheting adjustable wrench 20 according to the present invention. The wrench 20 has a handle portion 22 and a fastener engaging portion 24. The handle portion 22 includes a handle 26 terminating a distal end 28 in an aperture 30, which may be used to hang the wrench 20 from a peg or the like when not in use. The handle 26 has a downwardly depending proximal end 32, which joins the fastener engaging portion 24 at a first end 34 thereof. The fastener engaging portion 24 has a second end 36, at the outer extremity of which a fixed jaw member 38 is disposed. The fixed jaw member 38 has an inner face 40, on which a fixed jaw element 42 is formed. The fastener engaging portion 24 has a main body element 44, which terminates at one end in the first end 34, and at its opposite end in the second end 36. The main body portion 44 has a hollow central portion 46 formed by a pair of longitudinal rails 48, 50, extending between the first end 34 and the second end 36. Disposed within the hollow central body portion 46 are a movable jaw member 52 having a movable jaw element 53, a drive member 54, and a driven member 56. A ratcheting direction control mechanism 58 is located at the fastener engaging portion second end 36 and the handle distal end 28. The ratcheting direction control mechanism 58 includes a torque direction selector knob 60, which is mounted on a ratcheting mechanism cover plate 62. The cover plate 62 has right and left torquing indicators indicator dots 64,68, formed on the top surface thereof, corresponding to the selector knob alignments for clockwise fastener rotation and counterclockwise fastener rotation, as will be explained hereinafter.

Figure 3:
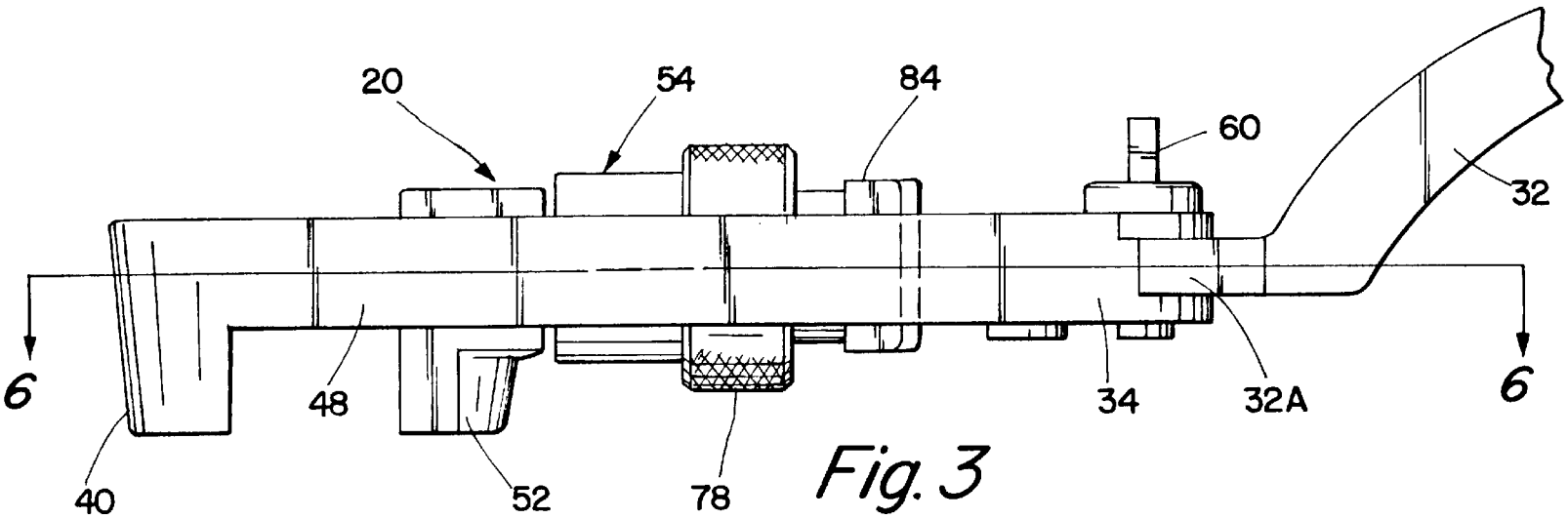
FIG. 3 is a right side elevational view of the portion of the wrench of FIG. 1 shown in FIG. 2.
Figure 4:
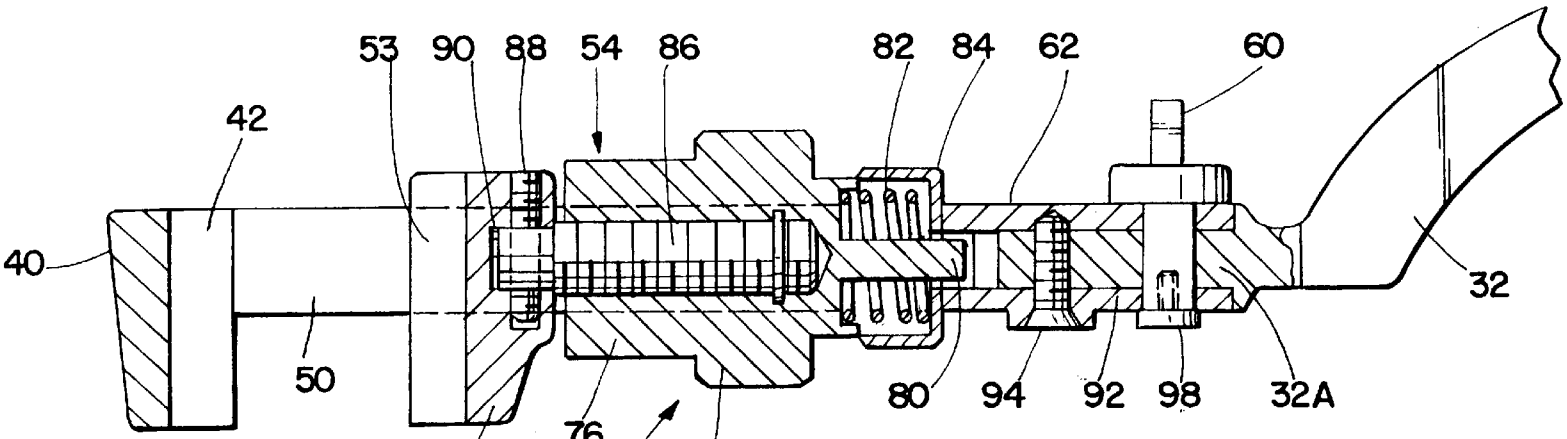
FIG. 4 is a right side elevational view, in section, of the wrench as shown in FIG. 3, taken along lines 4—4 of FIG. 2.
Figure 10:
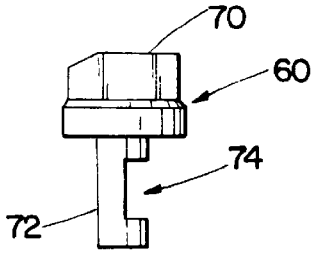
FIG. 10 is a left side elevational view of a ratcheting direction selector knob for use with the ratcheting adjustable wrench of FIG. 1.

As is seen in FIGS. 3 and 4, the ratcheting adjustable wrench 20 drive member 54 is longitudinally disposed between the jaw elements 42, 53 and the handle proximal end 32, so as to be separated from the latter by the torque direction selector knob 60, which is shown in left side elevation in FIG. 10. In FIG. 10, the knob 60 is seen to consist of a cap portion 70, adapted to be pinched between the user's thumb and forefinger to rotate the knob 60, and a cylindrical stem 72. The stem 72 has a semicircular cutout 74 formed therein, which enables the ratcheting and torquing functions to be performed when the knob is rotated to the appropriate position, as will be explained hereinafter.

Figure 5:
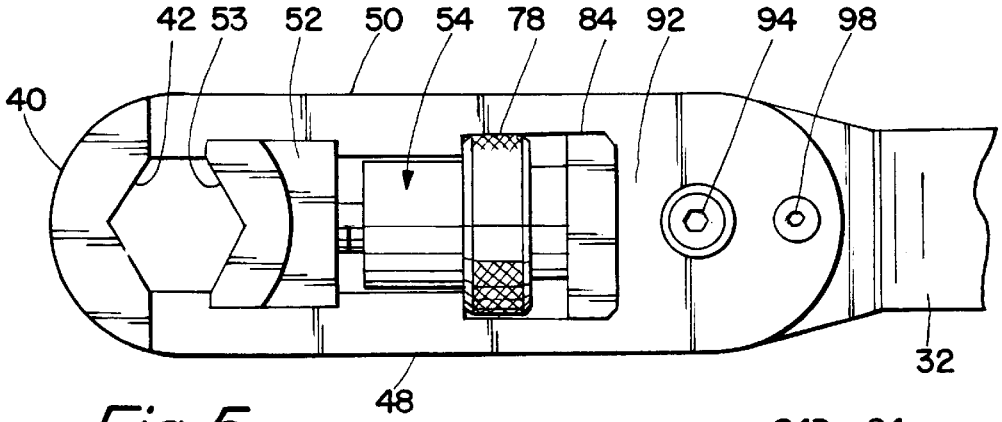
FIG. 5 is a bottom plan view of the wrench as shown in FIG. 2.
Figure 6:
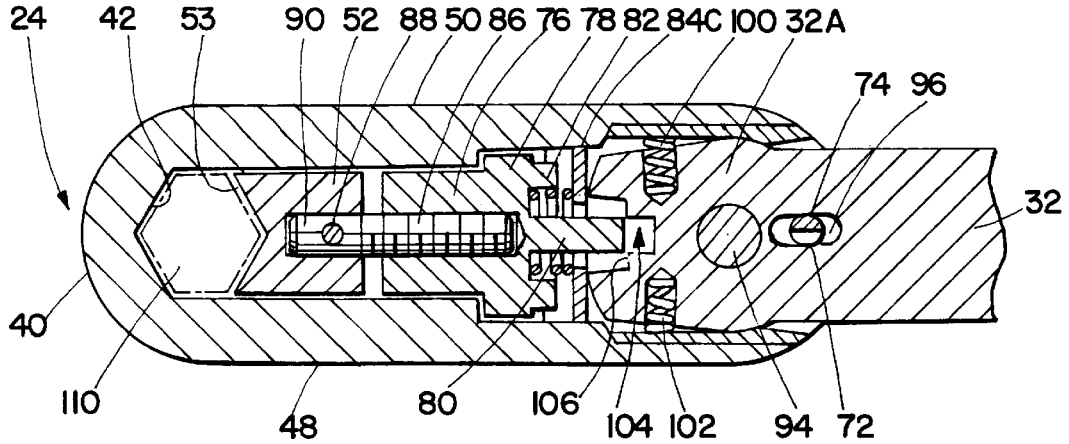
FIG. 6 is a top plan view, in section, of the wrench taken along lines 6—6 of FIG. 2.

Returning to FIG. 4, the drive member 54 is seen to consist of a threaded drive element portion 76, a knurled knob element 78 overlying a portion of the drive element 76, and an axially-extending pin 80. A bias spring 82 encloses the pin 80 and, in turn, is enclosed by a spring holder 84, held in position within the rails 48,50 by a proximal end extension portion 32A, as shown in FIG. 6, so as fix one end of the spring 82 against longitudinal movement toward the proximal end 32. As shown in FIG. 5, the spring 82 urges the knurled knob 78 toward the fixed jaw element 42 until further longitudinal movement of the knurled knob 78 toward the fixed jaw element 42 in response thereto is precluded by the engagement of the knurled knob 78 with a pair of shoulders 79 formed within the rails 48,50.

Figure 12:
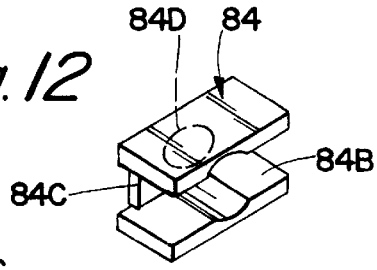
FIG. 12 is a view, in perspective, of a bias spring holder for use in the wrench of FIG. 1.

The spring holder 84 also functions to protect the spring 82 during use, and is shown in perspective in FIG. 12 for illustrative purposes, where it is seen that the spring holder 84 has a top plate 84A, a bottom plate 84B and a spring support plate 84C. An aperture 84D is formed in the spring support plate 84C, through which the axially extending pin 80 extends, as in shown in FIGS. 6 through 9, the reference numeral 84D being omitted in those figures for purposes of clarity.

Returning now to FIG. 6, disposed within the drive member 54 is a complementarily threaded driven member 86, which is fixed to the movable jaw 53 by a threaded fastener 88, which threadably engages the movable jaw member 52 and one end 90 of the driven member 86. As will therefore be apparent, rotation of the knurled knob 78 causes the movable jaw 53 to move toward or away from the fixed jaw 42, according to the direction of rotational direction of the knob 78. The handle proximal end extension portion 32A extends toward the jaws 42,53 in longitudinal alignment with the drive member 54. A web 92 (which is more clearly shown in FIG. 5) extends between the rails 48,50 adjacent the proximal end 32 so that the extension 32A is disposed between the cover plate 62 and the web 92. A pivot pin 94, shown for purposes of illustration only as a threaded fastener, but which is of any conventional structural configuration which provides bearing surfaces for a pivotal connection between members to permit relative rotary motion therebetween, extends between the cover plate 62 and the web 92 so as to hold the extension 32A therebetween in a pivotal relationship therebetween. The torque direction selector knob 60 extends through the cover plate 64 and through an operating aperture 96 formed in the extension 32A (see FIGS. 6–9) and is held within the extension 32A in contact with the web 92 by a fastener 98.

Figure 11:
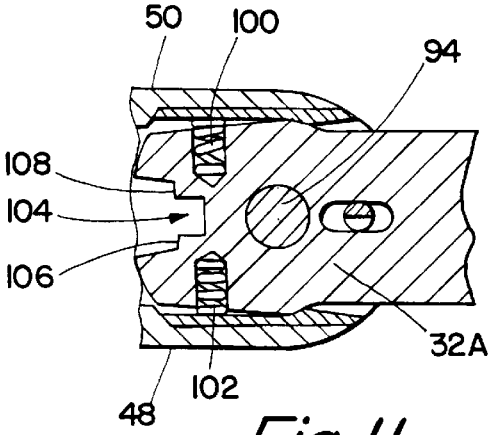
FIG. 11 is a partial sectional view of a portion of the ratcheting mechanism structure of the wrench of FIG. 1.

As is shown for purposes of clarity in FIG. 11, the proximal end extension 32A has a clockwise rotation return spring 100 and a counterclockwise rotation return spring 102. The springs 100, 102 are identical to one another and extend laterally inwardly from the rails 50,48, respectively, in bores formed in the proximal end 32A. The springs 100, 102 tend to hold the handle portion 22 in a neutral or rest position in longitudinal alignment with the fastener engaging portion 24, as is shown, for example, in FIG. 6, with respect to possible rotation of the extension 32A on the pivot 94.

The proximal end extension 32A is bifurcated by means of a central recess 104, which opens out onto a pair of shoulders 106,108. The central recess 104 and the shoulders 106,108 cooperate with the axially extending pin 80 in conjunction with positioning of the torque direction selector knob 60 to provide the ratcheting function for the wrench 20, as will now be described. While it is presently preferred that the shoulders 106,108 be formed as steps in the handle extension 32A as shown in FIGS. 6 through 9, the shoulders 106, 108 may also be formed as the ends of the handle extension 32A separated by the central recess 104.

Referring now to FIG. 6, the wrench 20 is shown in its neutral or rest position, but with the torque direction selector knob 60 set in its counterclockwise torque application position. With the selector knob 60 in this position, the wrench is operable to apply counterclockwise torque to a fastener if one were clamped between the jaw elements 42,53 by the appropriate closing of the jaw element 53 through manual rotation of the knurled knob 78, but would permit ratcheting of the fastener if clockwise torque were applied. This counterclockwise torque application position is determined by the rotational position of the cut out 74 in the operating aperture 96 in the proximal end extension 32A.

Figure 7:
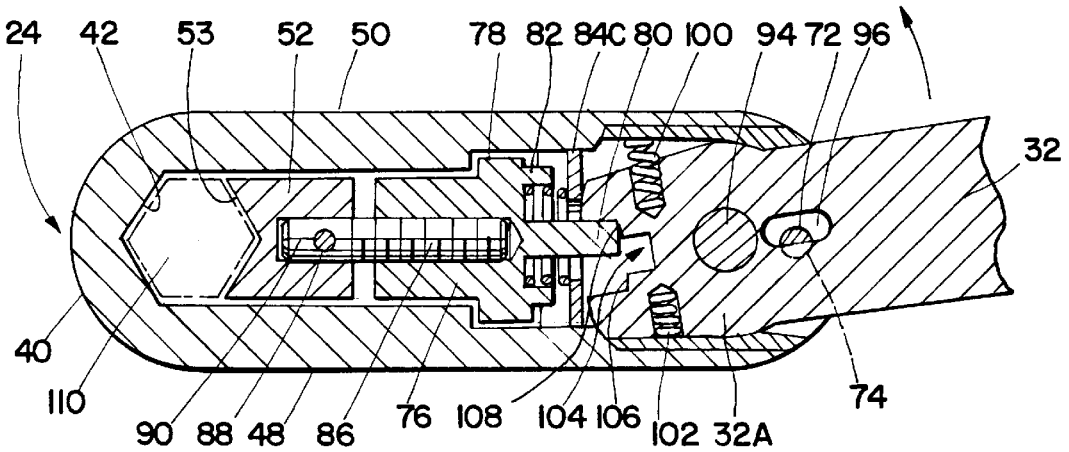
FIG. 7 is a view, in section, of the wrench as shown in FIG. 6, but with the wrench actuated to apply counterclockwise torque to a fastener.

The result of applying a counterclockwise force to the handle portion 22 and so the proximal end 32 is shown in FIG. 7. The proximal end 32 has pivoted a controlled amount about the pivot pin 94 in counterclockwise direction by reason of the movement of the extension 32A into the cut out 74 so as to be stopped by the stem 72, while the spring holder 84 continues to be held in place by the extension 32A. The axially extending pin 80 has engaged the stepped shoulder 108, so that the movable jaw 53 is locked in a clamping position against any fastener which was clamped between the jaws 42,53 prior to the counterclockwise rotation of the handle portion 22. Thus, the counterclockwise torque applied to the handle 22 is transmitted through the jaws 42,53 to a clamped fastener.

Figure 8:
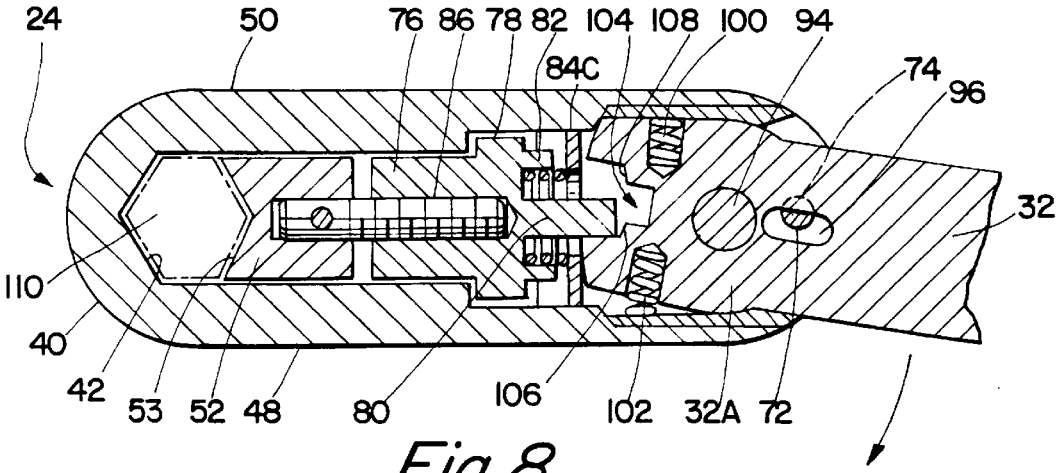
FIG. 8 is a view, in section, of the wrench as shown in FIG. 6, but with the wrench actuated to apply clockwise torque to a fastener.

Referring back to FIG. 6, as was stated above, the cut out 74 is shown in the position for the application of counterclockwise torque. Rotating the torque direction selector knob 60 by one hundred and eighty degrees from that disposition shown in FIG. 6 places the cut out in its operating position for applying clockwise torque to a fastener clamped between the jaws 43,53, as is shown in FIG. 8, where the wrench 20 is shown with clockwise torque already having been applied to the handle portion 22. As is seen in FIG. 8, upon the clockwise pivoting of the extension 32A about the pivot 94, limited in the same manner as described for FIG. 7, the axially extending pin 80 has engaged the stepped shoulder 106, thereby locking the spacing between the jaw elements 42,53, as in the operation described with respect to FIG. 7, but with respect to clockwise torque, rather than counterclockwise torque, application.

Figure 9:
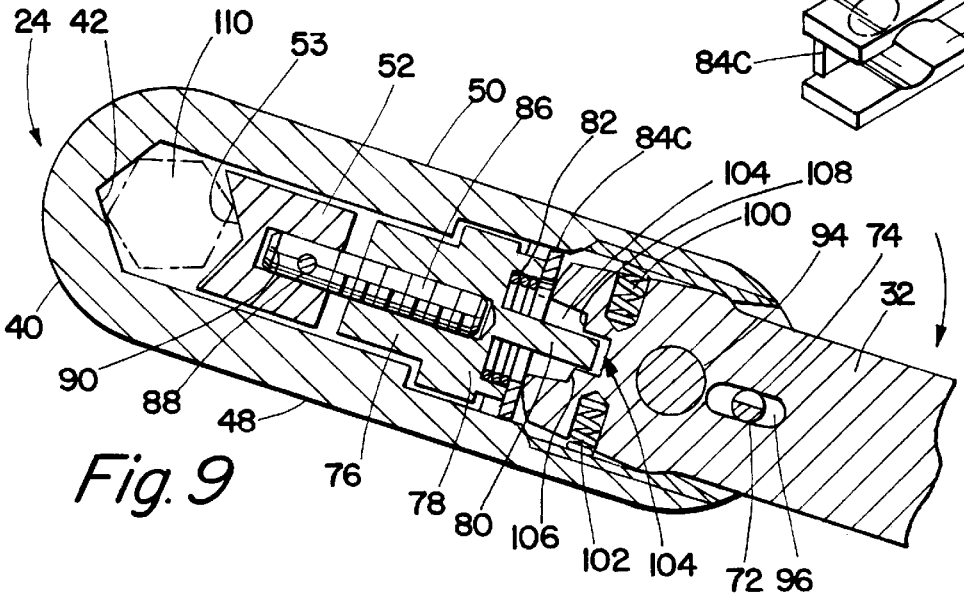
FIG. 9 is a view, in section, of the wrench as shown in FIG. 8, but with the wrench shown in its ratcheting disposition.

FIG. 9 shows the wrench 20 in the configuration shown in FIG. 8 for the application of clockwise torque, but with counterclockwise torque having been applied. When the counterclockwise torque was applied, ratcheting, rather than torquing, with respect to a fastener 110 previously clamped between the jaw elements 42,53 has resulted.

As is seen in FIG. 9, the counterclockwise movement of the handle portion 22 has caused the extension 32A to pivot in a counterclockwise direction, away from the position in which the axially extending pin 80 engaged the stepped shoulder 108, until stopped by the engagement, in the operating aperture 96, of the stem 72 and the extension 32A as shown in FIG. 9. The counterclockwise rotation of the handle portion 22 has resulted in the opening of the jaw elements 42,53, since the jaw element 53 is no longer locked in position with respect to the fixed jaw element 42 by the engagement of the axial extending pin 80 and the stepped shoulder 108. The longitudinal force applied by the fastener 110 to the movable jaw element 53 upon counterclockwise handle portion 22 movement has overcome the urging of the bias spring 82, permitting the movable jaw element 53 to open away from the fixed jaw element 42 by permitting the axially extending pin 80 to move into the bifurcation central recess 104. The fastener engaging portion 24 then ratchets in a counterclockwise direction about the fastener 110 as the bias spring 82 urging is overcome by the existing friction between the fastener 110 and a workpiece (not shown) containing it.

Upon a return to clockwise motion, the movable jaw 53, under the urging of the bias spring 82, initially will clamp the fastener 110 between the jaw elements 42,53 while withdrawing the axially extending pin 80 from the bifurcation central recess 104, similar to the configuration shown in FIG. 6, as the jaw elements mate with the complementary faces of the fastener. (In FIGS. 6,7,8, the fastener 110 is shown as reduced in size from that shown in FIG. 9, the reduced fastener 110 depictions of FIGS. 6,7,8 being for orientation purposes only). On additional clockwise motion, the wrench 20 will return to the disposition shown in FIG. 8 for additional clockwise torque application to the fastener 110. The process is repeated as many times as required until the desired amount of clockwise torque has been applied to the fastener 110.

While the ratcheting operation of the wrench 20 has been described in the preceding paragraph only for ratcheting with respect to the application of clockwise torque to a fastener, it is obvious that the same operation of the axially extending pin 80 and bifurcation central recess 104 to permit ratcheting will occur if the wrench is set up for the application of counterclockwise torque, upon the application of clockwise torque. That is, upon the application of clockwise torque to the handle 22 when the wrench 20 is in the disposition shown in FIG. 7, the extension 32 will pivot in a clockwise direction until stopped by the contact of the stem 72 and extension 32A in the operating aperture 96 as shown in FIG. 6. The axially extending pin 80 then no longer is supported by the step 108, and can not reach the step 106 because further rotation of the extension 32A is precluded by the engagement of the stem 72 and extension 32A. The axially extending pin 80 therefore is moved into the bifurcated central recess 104 by the overcoming of the bias spring 82 urging by the continued counterclockwise movement of the handle 22, permitting the fastener engaging portion 24 to ratchet about the fastener 110. Upon the resumption of clockwise movement, the movable jaw element 53 clamps the fastener 110 against the fixed jaw element 42 in a mated relationship, as is depicted in FIG. 6, terminating the ratcheting action, and further clockwise movement causes the wrench 20 to assume the disposition shown in FIG. 7 for further torquing of the fastener 110.

Referring to FIGS. 6, 7 and 8, the operation of the return springs 100, 102 is illustrated. In FIG. 6, where the handle 32 is in its neutral or rest position, the compression of the springs 100, 102 is identical to one another. However, in FIG. 7, with the handle proximal end 32 rotated in a counterclockwise direction, the spring 100 has expanded, and the spring 102 has been compressed. Therefore, when the counterclockwise rotational force is removed from the handle proximal end 32, the counterclockwise rotation spring 102 urges the handle to rotate in a clockwise direction about the pivot 94, so as to permit the wrench 20 to assume the disposition shown in FIG. 9, thereby permitting the wrench to ratchet in a counterclockwise direction about the fastener 110, as described above with respect to FIG. 9. Similarly, as is illustrated in FIG. 8, the clockwise rotation of the handle proximal end 32 causes the spring 100 to be compressed and the spring 102 to expand. Upon removal of the clockwise rotation-initiating force, the clockwise rotation return spring 100 urges the handle to return to its neutral position and permits the wrench 20 to ratchet in a counterclockwise direction about the fastener 110.

FIGS. 13 through 20 show a ratcheting adjustable wrench 120, which is a presently preferred alternate embodiment of the wrench 20 shown in FIGS. 1 through 12. The wrench 120 differs from the wrench 20 principally in the placement of the return springs so as to be in direct contact with the torque direction control knob, rather than being separated therefrom by the pivot 94. The other portions of the wrenches 20 and 120 preferably are identical, unless otherwise shown in FIGS. 13 through 20.

Figure 13:
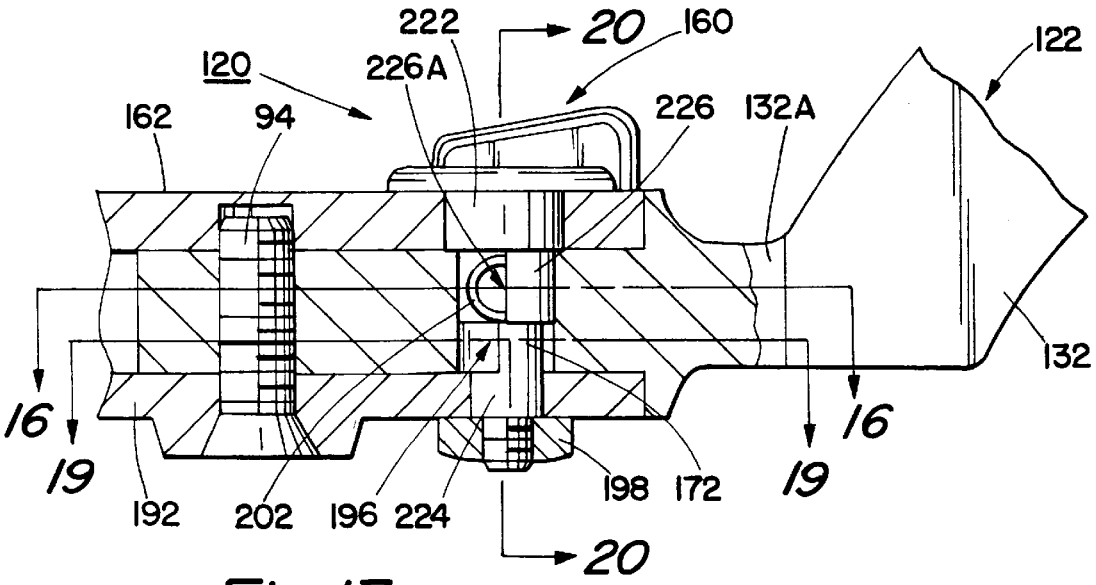
FIG. 13 is a right side partial elevational view, partially in section, of an alternate embodiment of the wrench of FIG. 1, in which a presently preferred embodiment of a ratcheting direction selector knob is utilized, and is shown in its neutral position.
Figure 14:
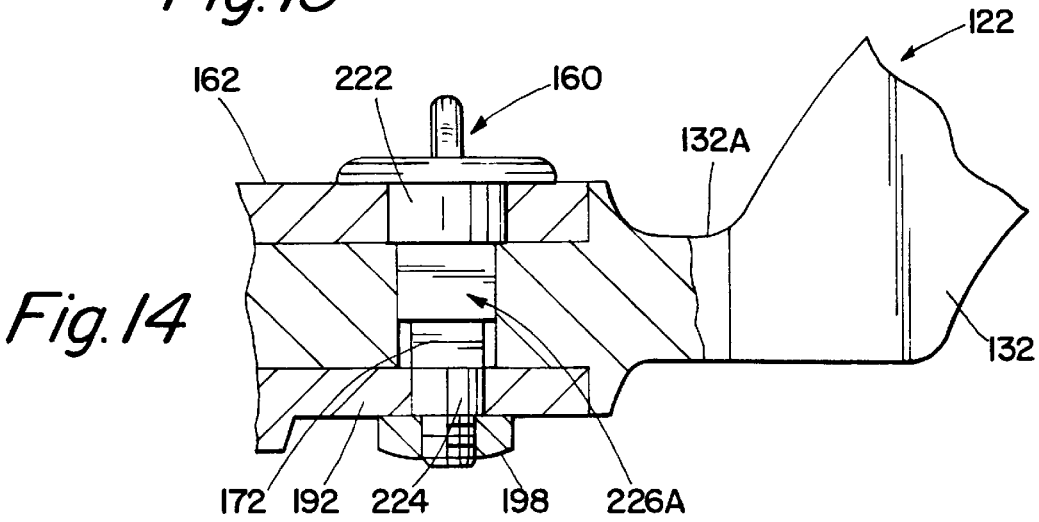
FIG. 14 is a right side elevational view of the alternate embodiment of the wrench according to FIG. 13 and in which the ratcheting direction selector knob is shown in its position for the application of clockwise torque to a fastener.
Figure 15:
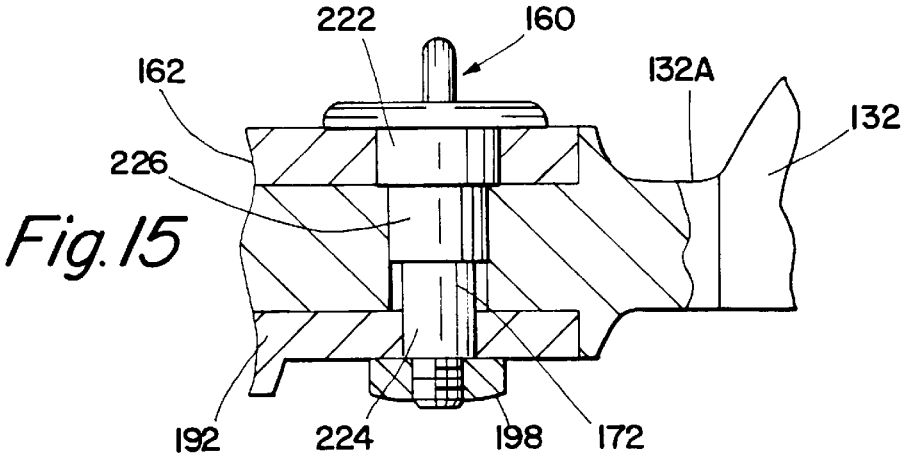
FIG. 15 is a right side elevational view of the alternate embodiment of the wrench according to FIG. 13 and in which the ratcheting direction selector knob is shown in its position for the application of counterclockwise torque to a fastener.

Referring now to FIG. 13, the wrench 120 has a handle portion 122 with a downwardly depending proximal end 132 with a proximal end extension portion 132A, which is generally similar to the proximal end extension portion 32A. The proximal end extension 132A is covered on top by a cover plate 162, and, on the sides and bottom by a web 192, which may be generally similar to the web 92 of FIGS. 1 through 12.

A torque direction control knob 160 extends through the cover plate 162, proximal end extension 132A and web 192 and engages a nut 198 to hold the knob 160 in this position. The torque direction control knob 160 has an upper bearing surface 222 which engages to cover plate 162, a lower bearing surface 224 which engages the web 192, a spring engaging stem 226 formed immediately below the upper bearing surface 222, and a stem portion 172 with a cutout 174, similar to and which function in the same manner as do the stem portion 72 and cut out 74 of the wrench of FIGS. 1 through 12.

Figure 20:
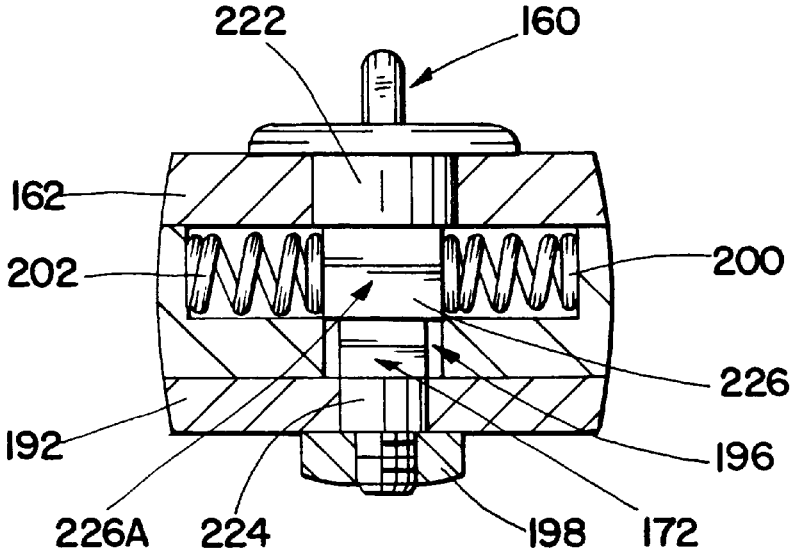
FIG. 20 is a view, in section, taken along lines 20—20 of FIG. 13.

Referring now to FIG. 20, which is a view, in section, taken along line 20—20 of FIG. 13, the wrench 120 is seen to have a pair of laterally-extending slots, within which a clockwise rotation return spring 200 and a counterclockwise rotation return spring 202 are disposed so as to abut the spring engaging stem 226. Other than in their location, the springs 200, 202 are identical.

The spring engaging stem 226 has a cut out face 226A formed thereon, which functions to increase the effectiveness of the return spring 200 or 202 which is compressed upon handle rotation. The cut out face 226A receives the one of the springs 200,202 not being further compressed upon handle rotation, thereby permitting additional expansion of that spring so as to further reduce its effectiveness as compared to the spring being compressed, as is illustrated by a comparison of FIGS. 16, 17 and 18.

Figure 16:
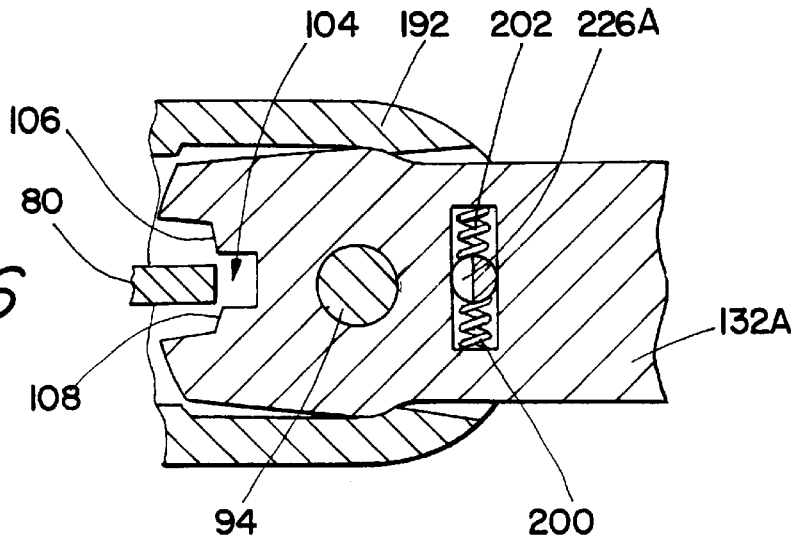
FIG. 16 is a view, in section, similar to that of FIG. 6, taken along lines 16—16 of FIG. 13 with the ratcheting selector knob in its neutral position.
Figure 17:
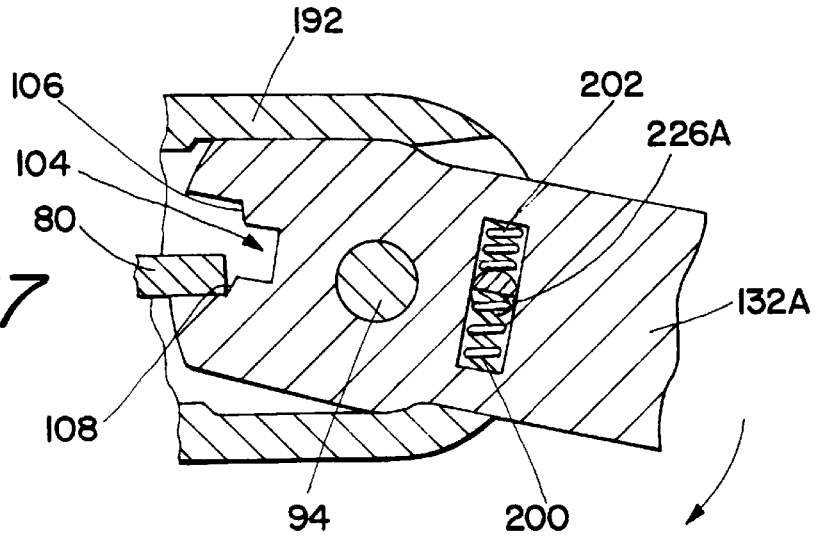
FIG. 17 is a view, in section, similar to that of FIG. 8, taken along lines 17—17 of FIG. 14.

In FIG. 16, taken along lines 16—16 of FIG. 13, the handle proximal end 132A is shown in its neutral disposition, in which each of the springs 200, 202 is equally compressed. Rotation of the handle proximal end 132A about the pivot 94 in a clockwise direction, as shown in FIG. 17, so that the axially extending pin 80 engages the shoulder 108, compresses the return spring 202 against the stem 226 while permitting the return spring 200 to expand by riding against the cut out face 226A, thereby increasing the differential between the opposing urgings of the return springs 200,202 over that provided by the additional compression of the return spring 202 resulting from handle movement alone when the clockwise handle rotation force is removed.

Figure 18:
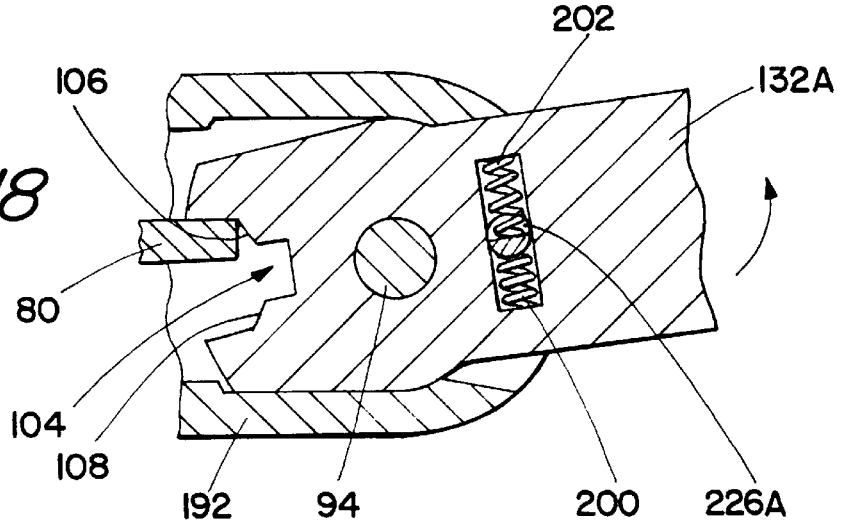
FIG. 18 is a view, in section, similar to that of FIG. 7, taken along lines 18—18 of FIG. 18.

Similarly, in FIG. 18, the counterclockwise rotation of the handle proximal end 132A about the pivot 94 has compressed the return spring 200 while permitting the return spring 202 to expand against the cut out face 226A, thereby increasing the differential between the opposing urgings of the return springs 200,202 when the clockwise handle rotation force is removed over that provided solely by the additional compression of the return spring 200 resulting from handle movement alone.

Figure 19:
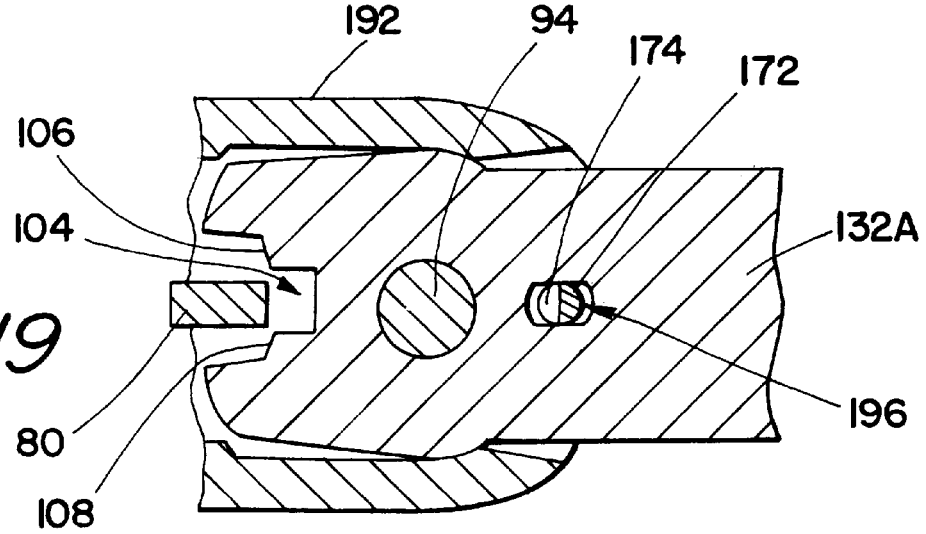
FIG. 19 is a view, in section, similar to that of FIG. 6, taken along lines 19—19 of FIG. 13.

Referring now to FIG. 19, which is a view, in section, taken along lines 19—19 of FIG. 13, the wrench 120 is shown with the torque direction control knob 160 (not shown, see FIG. 13) in its neutral position. The handle proximal end 132A has a slot 196 formed therein which is similar in form and function to the slot 96 the wrench 20 as shown in FIGS. 6 through 9. In FIG. 19, the stem portion 172 engages the sides of the slot 196, thereby preventing rotation of the handle proximal end 132A about the pivot 94. Rotation of the torque direction control knob ninety degrees in a counterclockwise direction will cause the stem portion 172 and cut out 74 to assume the relationship with the slot 196 as shown in FIGS. 6 and 7 for the wrench 20. Rotation of the torque direction control knob ninety degrees in a clockwise direction will cause the stem portion 172 and cut out 74 to assume the relationship with the slot 196 as shown in FIGS. 8 and 9 for the wrench 20. Therefore, it is apparent that the preceding description with respect to FIGS. 6 through 9 also describes the operation of the torque direction control knob 160 and the ratcheting function of the operation of the wrench 120.

The ratcheting adjustable wrenches 20, 120 are strong, easy to use, can be used in close quarters, can be inverted for use in order to grip the fastener element from either side of the wrench, and fully grip the fastener element to which torque is to being applied while permitting the wrench to ratchet on it.

Two embodiments of the invention have been set forth herein in the FIGURES in detail for illustrative purposes. It will be apparent to those skilled in the art that variations and modifications thereof lie within the scope of the present invention. Therefore, the present invention includes both the specific structures of the embodiments shown or described herein and their equivalents, and is limited in scope only by the permissible scope of the following claims.

The invention claimed is:

1. A ratcheting adjustable wrench having an elongated handle;

jaw means having a fixed member and a movable member;

means, including a pin, joining the jaw means fixed member to one end of the handle, the jaw means fixed member having a generally hollow central portion, a first end to which the handle is joined, and a second end terminating in a first jaw element, the jaw means movable member being disposed in the hollow central portion and having a second jaw element formed at a first end thereof so as to face the first jaw element, the first and second jaw elements opening onto each other;

means for limiting the movement of the second jaw element within the hollow central portion to linear longitudinal motion toward and away from the first jaw element;

means for selectively manually initiating longitudinal relative movement between the first jaw element and the second jaw element comprising a threaded drive member axially aligned with the second jaw element and disposed between the second jaw element and the handle, means for fixing the drive member within the hollow central portion so that the drive member is laterally fixed in position and rotatable therewithin in axial alignment with the second jaw element, including a complementarily threaded driven member fixed to said second jaw element and extending through the drive member, whereby selective manual rotation of the drive member in a first direction is operable to move the second jaw element in a first linear direction toward the first jaw element to clamp a fastener therebetween, and selective manual rotation of the drive member in the opposite direction moves the second jaw element in the opposite linear direction to release the clamping of the fastener; and ratcheting means (a) operable in response to torque applied to the handle in a selected rotary direction to longitudinally fix the first and second jaw elements with respect to a fastener clamped therebetween, whereby said selected direction torque is applied to the fastener; and (b) operable in response to torque applied to the handle in a direction opposite the selected rotary direction to release the clamping of the fastener by permitting the drive member and so the second jaw element to move away from the first jaw element so as to permit rotary relative movement between the fastener and the jaw elements.

2. A wrench according to claim 1, and in which said ratcheting means includes a bias spring disposed in said hollow central portion between the drive member and the handle first end, said bias spring being operable to normally urge the drive member and so the second jaw element toward the first jaw element.

3. A wrench according to either claim 1 or claim 2, and in which said ratcheting means includes a pin formed on the drive member so as to be longitudinally aligned in said hollow central portion and extend toward the handle first end, and a central recess formed in the handle first end between a pair of shoulders formed thereon so as to be longitudinally aligned with said pin, whereby the pin engages one of said shoulders upon movement of the handle in said selected rotary direction so as to fix the first and second jaw elements and the pin moves into longitudinal alignment with the central recess upon movement of the handle in the direction opposite the selected direction to permit the second jaw element to move away from the first jaw element in response to said opposite direction handle movement when the jaw elements engage a fastener.

4. A wrench according to claim 3, and in which said ratcheting means includes torque direction control knob means engaging said handle one end and selectively operable when the jaw elements engage a fastener (a) to preclude rotary relative movement between the handle and the jaw means from the longitudinal alignment thereof, or (b) to permit limited relative rotary movement of the handle with respect to the jaw means in the selected rotary direction between (i) the longitudinally aligned position thereof, and (ii) an operating position in which the pin engages one of the shoulders.

5. A wrench according to claim 4, and including means for normally urging the rotary relative movement between the jaw means and the handle to the longitudinally aligned position when the jaw means and the handle are disposed in the operating position.

6. A wrench according to claim 5, and including a pair of like spring elements disposed in the handle end in opposing relationship to one another so that, upon movement of the handle in the selected direction, one of the spring element is compressed and the other expands, whereby the handle end is urged to return to the position in which it is longitudinally aligned with the jaw means.

7. A wrench according to claim 6, and in which said spring elements engage the jaw means.

8. A wrench according to claim 6, and in which the torque direction control knob means includes a torque direction control member, and in which said spring elements are disposed to either side of the torque direction control knob and are in engagement therewith.

9. A wrench according to claim 1, and including selector means for selecting whether the first direction torque is clockwise torque or counterclockwise torque.

10. A ratcheting adjustable wrench comprising:

an elongated handle;

jaw means, including a fixed jaw element and a movable jaw element opening on to each other;

means, including a pivot pin, joining the jaw means to one end of the handle so that the jaw means and handle are normally in longitudinal alignment with one another;

means for selectively initiating longitudinal relative movement between the jaw elements by means of rotation of a drive member, whereby selective manual rotation of the drive member in a first direction is operable to close the jaw elements about a fastener disposed between, and selective manual rotation of the drive member in the opposite direction is operable to open the jaw elements with respect to the fastener; and ratcheting means (a) selectively operable in response to torque applied to the handle in a selected first direction to fix the jaw elements with respect to a fastener on which the jaw elements are closed, whereby said first direction torque is applied to the fastener, and (b) operable in response to torque applied to the handle in a direction opposite the selected first direction to permit rotary relative motion between the fastener and the jaw elements.

11. A wrench according to claim 10, and including selector means for selecting whether the first direction torque is clockwise torque or counterclockwise torque.

12. A wrench according to claim 10, and in which the means for selectively initiating longitudinal relative movement between the jaw elements by means of rotation of the drive member includes the drive member having a longitudinal threaded bore which is axially aligned with the movable jaw element, the drive member being disposed between the movable jaw element and the handle, and means for attaching the drive member to the jaw means so that the drive member is laterally fixed in position and rotatable in axial alignment with the movable jaw element, and including a complementarily threaded driven member fixed to said movable jaw element and engaging the drive member threaded bore.

13. A wrench according to claim 12, and including a bias spring disposed in between the drive member and said one end of the handle and operable to normally urge the movable jaw element toward the fixed jaw element.

14. A wrench according to claim 12, and including selector means for selecting whether the first direction torque is clockwise torque or counterclockwise torque.

15. A wrench according to claim 13, and including selector means for selecting whether the first direction torque is clockwise torque or counterclockwise torque.

16. A ratcheting adjustable wrench comprising:

an elongated handle;

jaw means, including a fixed jaw element and a movable jaw element opening on to each other;

means, including a pivot pin, joining the jaw means to one end of the handle so that the jaw means and handle are normally in longitudinal alignment with one another;

means for selectively initiating longitudinal relative movement between the jaw elements by means of rotation of a drive member, whereby selective manual rotation of the drive member in a first direction is operable to close the jaw elements about a fastener disposed between, and selective manual rotation of the drive member in the opposite direction is operable to open the jaw elements with respect to the fastener; and ratcheting means (a) selectively operable in response to torque applied to the handle in a selected first direction to permit the limited rotary relative movement of the handle with respect to the jaw means in the first direction and to fix the jaw elements with respect to a fastener on which the jaw elements are closed, whereby said first direction torque is applied to the fastener, and (b) operable in response to torque applied to the handle in a direction opposite the selected first direction to permit rotary relative motion between the fastener and the jaw elements, and including selector means for selecting whether the first direction torque is clockwise torque or counterclockwise torque.

17. A wrench according to claim 16, and in which the selector means includes a rotatable selector pin extending through the jaw means and the handle end adjacent to and in longitudinal alignment with the pivot pin, the handle end has an aperture formed in a portion thereof through which the selector pin passes, and the selector pin has a cut out formed along its axis so as to be at least coincident with the handle end portion aperture, whereby when the cut out is disposed transversely with respect to the longitudinal alignment of the jaw elements and pivot pin, the handle cannot be rotated about the pivot pin, and when the cut out is longitudinally aligned with the jaw elements and pivot pin so as to face away from the first direction, the handle end portion adjacent the cut out is rotatable about the pivot pin in the first direction into the cut out, so as to clamp the fastener between the jaw elements.

18. A wrench according to claim 17, and in which the means for selectively initiating longitudinal relative movement between the jaw elements by means of rotation of the drive member includes the drive member having a longitudinal threaded bore which is axially aligned with the movable jaw element, the drive member being disposed between the movable jaw element and the handle, and means for fixing the drive member to the jaw means so that the drive member is laterally fixed in position and rotatable in axial alignment with the movable jaw element, and including a complementarily threaded driven member fixed to said movable jaw element and engaging the drive member threaded bore.

19. A wrench according to claim 18, and including a bias spring disposed between the drive member and said one end of the handle and operable to normally urge the movable jaw element toward the fixed jaw element.

20. A wrench according to any one of claims 3, 4, 5, 6, 7, 8, 9, 10, 11 or 12, and in which the jaw means includes a fixed member having a generally hollow central portion, a first end to which the handle is joined, and a second end terminating in the fixed jaw element, and in which the movable jaw element is disposed in the hollow central portion so as to face the first jaw element; and including means for limiting the movement of the movable jaw element within the hollow central portion to linear longitudinal motion toward and away from the fixed jaw element.

* * * * *